US011322895B2

(12) United States Patent
Bergner et al.

(10) Patent No.: US 11,322,895 B2
(45) Date of Patent: May 3, 2022

(54) CONNECTOR SHIELDING WITH A CIRCUMFERENTIAL RETENTION ELEMENT

(71) Applicants: TE Connectivity Germany GmbH, Bensheim (DE); TE Connectivity India Private Limited, Karnataka (IN)

(72) Inventors: Bert Bergner, Rimbach (DE); Gunther Mumper, Egelsbach (DE); Gururaj A. Hiremath, Karnataka (IN); Sundareshan M D, Karnataka (IN)

(73) Assignees: TE Connectivity Germany GmbH, Bensheim (DE); TE Connectivity India Private Limited, Bangalore (IN)

( * ) Notice: Subject to any disclaimer, the term of this patent is extended or adjusted under 35 U.S.C. 154(b) by 0 days.

(21) Appl. No.: 17/004,792

(22) Filed: Aug. 27, 2020

(65) Prior Publication Data

US 2021/0066861 A1 Mar. 4, 2021

(30) Foreign Application Priority Data

Aug. 27, 2019 (EP) ..... 19193933

(51) Int. Cl.

| | |
|---|---|
| ***H01R 13/6585*** | (2011.01) |
| ***H01R 13/6582*** | (2011.01) |
| ***H01R 13/6593*** | (2011.01) |
| ***H01R 43/16*** | (2006.01) |

(52) U.S. Cl.

CPC ..... *H01R 13/6585* (2013.01); *H01R 13/6582* (2013.01); *H01R 13/6593* (2013.01); *H01R 43/16* (2013.01)

(58) Field of Classification Search

CPC ..... H01R 13/6585; H01R 13/6582; H01R 13/6593; H01R 43/16

USPC ..... 439/607.41

See application file for complete search history.

(56) References Cited

U.S. PATENT DOCUMENTS

| | | | | |
|---|---|---|---|---|
| 6,217,381 | B1 * | 4/2001 | Kameyama | H01R 9/0518 439/578 |
| 6,808,417 | B2 * | 10/2004 | Yoshida | H01R 9/0518 439/585 |
| 8,057,258 | B2 * | 11/2011 | Kawaguchi | H01R 13/6593 439/585 |
| 8,303,343 | B2 * | 11/2012 | Nagata | H01R 13/6582 439/607.54 |
| 8,777,665 | B2 * | 7/2014 | Il | H01R 13/6593 439/607.27 |

(Continued)

FOREIGN PATENT DOCUMENTS

| | | |
|---|---|---|
| EP | 3002829 A1 | 4/2016 |
| JP | 9-129316 A | 5/1997 |

OTHER PUBLICATIONS

Extended European Search Report, dated Feb. 11, 2020, 8 pages.

*Primary Examiner* — Peter G Leigh
(74) *Attorney, Agent, or Firm* — Barley Snyder

(57) ABSTRACT

A shielding for a signal connector includes a plurality of shielding walls arranged to electromagnetically shield a signal contact of the signal connector, a forward end open for receiving a mating connector along an insertion direction, and a longitudinal circumferential retention element extending along a circumferential direction of the shielding. At least two of the shielding walls are parallel with each other at least in sections in a cross-section perpendicular to the insertion direction.

16 Claims, 4 Drawing Sheets

(56) References Cited

U.S. PATENT DOCUMENTS

| | | | | |
|---|---|---|---|---|
| 8,870,596 | B2 * | 10/2014 | Ii | H01R 13/6581 439/607.41 |
| 9,531,132 | B2 * | 12/2016 | Iwamoto | H01R 13/65915 |
| 9,673,568 | B2 * | 6/2017 | Tanaka | H01R 13/6593 |
| 9,865,970 | B2 * | 1/2018 | Abe | H01R 4/185 |
| 10,103,498 | B2 * | 10/2018 | Maesoba | H01R 13/516 |
| 2004/0242035 | A1 | 12/2004 | Murayama et al. | |
| 2011/0201228 | A1 * | 8/2011 | Schumacher | H01R 13/516 439/374 |

* cited by examiner

CONNECTOR SHIELDING WITH A CIRCUMFERENTIAL RETENTION ELEMENT

CROSS-REFERENCE TO RELATED APPLICATION

This application claims the benefit of the filing date under 35 U.S.C. § 119(a)-(d) of European Patent Application No. 19193933.9, filed on Aug. 27, 2019.

FIELD OF THE INVENTION

The present invention relates to a connector and, more particularly, to a shielding for a connector.

BACKGROUND

Shieldings for signal connectors are used for electromagnetically shielding signal contacts inside a signal connector. The shieldings thereby protect signal contacts and the signal lines from outer influences such as electromagnetic fields. Shieldings for signal connectors are sometimes provided with latching devices, for example holes or hooks, that can be brought into engagement with complementary engagement devices on a housing in order to fixate the shielding in the housing.

Known elements for fixating the shielding in a housing, however, are often designed to be used with a predefined housing. If a known shielding is to be used with a different kind of housing, this usually leads to design changes in both the housing and the shielding. However, changing the design of a shielding usually also alters the electromagnetic properties of the shielding such that the signal transmission of a signal contact inside the shielding may be affected and additional design changes for adapting the signal transmission inside the signal connector may also be necessary.

SUMMARY

A shielding for a signal connector includes a plurality of shielding walls arranged to electromagnetically shield a signal contact of the signal connector, a forward end open for receiving a mating connector along an insertion direction, and a longitudinal circumferential retention element extending along a circumferential direction of the shielding. At least two of the shielding walls are parallel with each other at least in sections in a cross-section perpendicular to the insertion direction.

BRIEF DESCRIPTION OF THE DRAWINGS

The invention will now be described by way of example with reference to the accompanying Figures, of which.

DETAILED DESCRIPTION OF THE EMBODIMENT(S)

In the following, the invention and its improvements are described in greater detail using exemplary embodiments and with reference to the drawings. The various features shown in the embodiments may be used independently of each other in specific applications. In the following figures, elements having the same function and/or the same structure will be referenced by the same reference signs.

Figure 1:
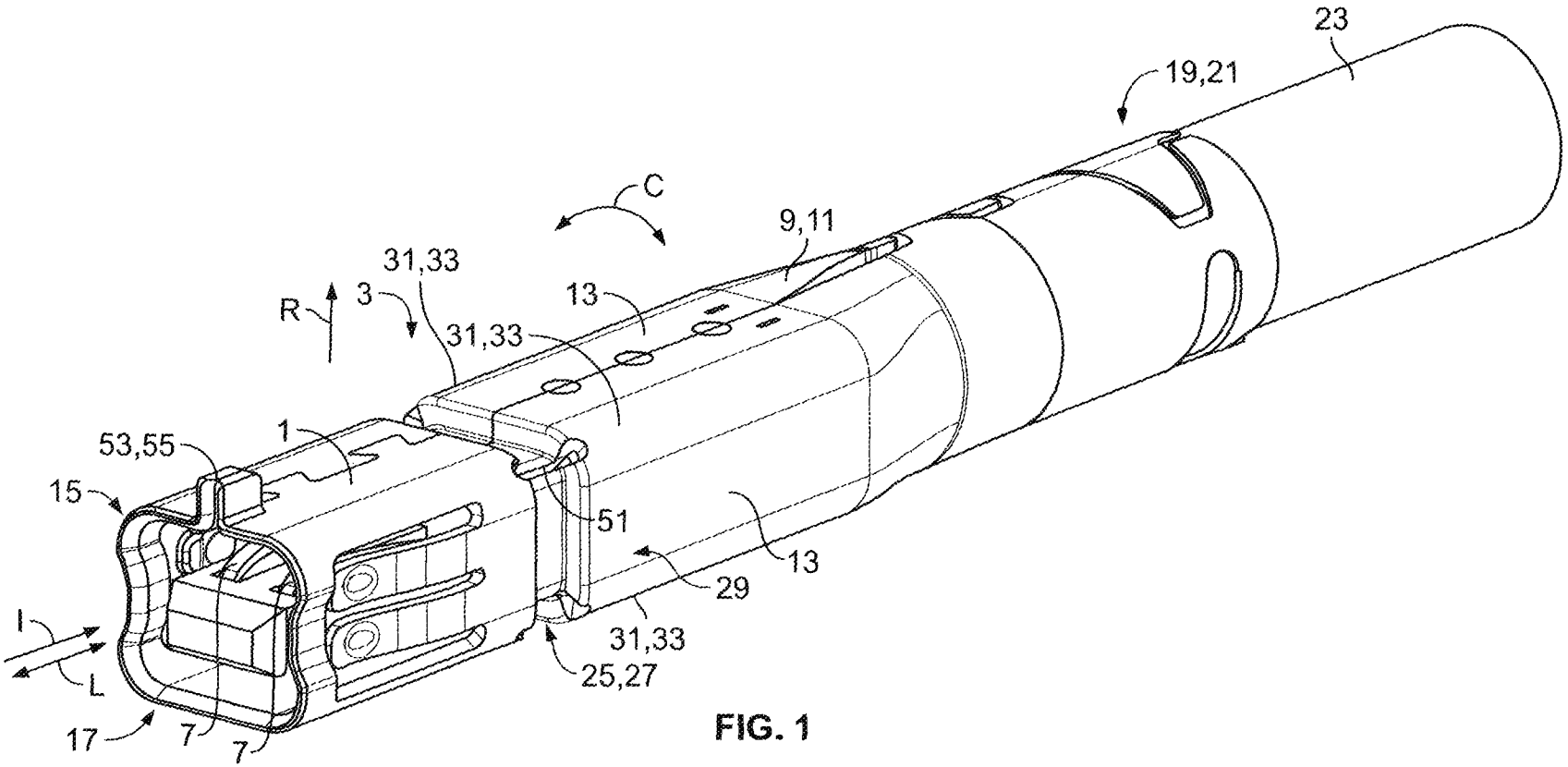
FIG. 1 is a perspective view of a signal connector with a shielding according to an embodiment.
Figure 2:
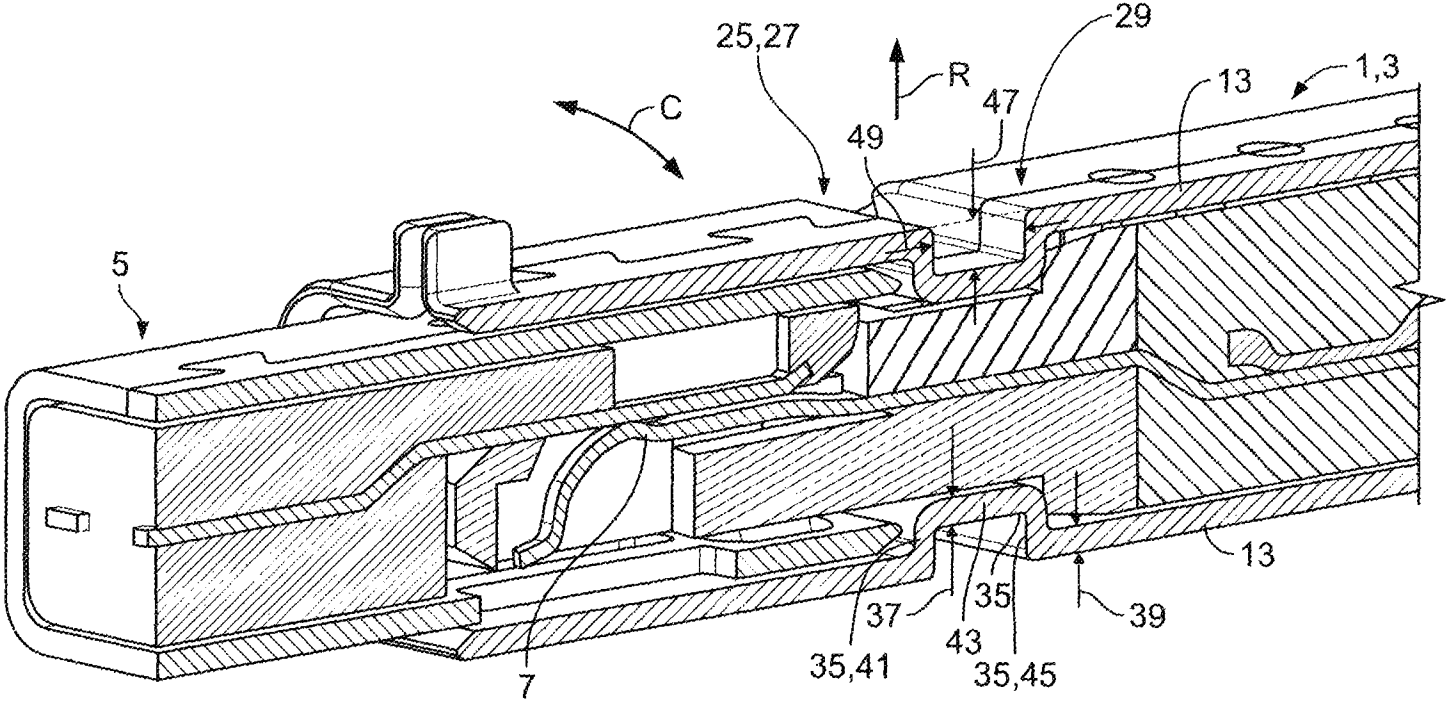
FIG. 2 is a sectional perspective view of the signal connector of FIG. 1 with an inserted mating connector.

A shielding 1 according to an embodiment for a signal connector 3 is shown in FIGS. 1 and 2. The shielding 1 is part of the signal connector 3. The shielding 1 basically extends along a longitudinal axis L that extends parallel with an insertion direction I along which a mating connector 5, shown in FIG. 2, can be mated with the connector 3.

The signal connector 3, as shown in FIG. 1, has at least one signal contact 7. The embodiment shown in the figures is shown just by way of example with two signal contacts 7. The shielding 1 basically surrounds the signal contacts 7 circumferentially. A circumferential direction C extends around the longitudinal axis L.

The shielding 1, in an embodiment, is a stamp-bent part 9 and formed from an electrically conductive flat sheet material 11 by stamp bending. The sheet material 11 is a metal in an embodiment.

The shielding 1 is formed by shielding walls 13 that basically extend parallel with the longitudinal axis L. At least two of the shielding walls 13 are arranged parallel with each other. In the embodiment shown in FIGS. 1 and 2, the four shielding walls 13 form a shielding 1 with an overall rectangular cross section. The cross section is perpendicular to the circumferential direction C. The shielding walls 13, in an embodiment, are formed monolithically with each other from the sheet material 11.

The shielding 1 has a forward end 15 at which the shielding 1 is open for receiving the mating connector 5 along the insertion direction I, as shown in FIG. 1. The shielding 1 thereby opens up a receptacle 17 for the mating connector 5. At a rearward end 19 of the shielding 1 that lies opposite the forward end 15 along the longitudinal axis L, the shielding 1 may be provided with a crimp barrel 21 that can be crimped around a cable 23, in particular around a shielding layer of the cable 23 or around an insulation layer of the cable 23.

The shielding 1, as shown in FIGS. 1 and 2, has a longitudinal circumferential retention element 25. The longitudinal circumferential retention element 25 is, in the following, named "element 25" for the sake of brevity.

In the embodiment as shown in FIGS. 1 and 2, the elements 25 are formed as a groove 27. In the alternative, the element 25 could be shaped as a rib that protrudes from the shielding walls 13 in a radial direction R that extends perpendicular to the longitudinal axis L. However, a groove 27 is present in the shown embodiment because a shielding 1 with a groove 27 as element 25 needs less space such that more shieldings 1 can be combined in a housing of a given volume compared to a shielding 1 that is provided with ribs instead of grooves 27. The groove 27 extends along the radial direction R into the shielding 1. In other words, the groove 27 extends into a peripheral surface 29 of the shielding 1.

The longitudinal circumferential element 25 can easily be formed by providing the shielding 1 with a deviation in its peripheral surface 29. In other words, the cross section of the shielding 1 may deviate in the region of the longitudinal circumferential retention element 25. The groove 27 may form a cross section reduction of the shielding 1, wherein the cross section is seen perpendicular to the insertion direction I. The groove 27 in the shielding 1 may thereby form a "waist" in the peripheral surface 29.

The longitudinal circumferential element 25, in an embodiment, extends continuously along the circumferential direction C of the shielding 1. In particular, the element 25 may extend around the majority of the circumference and thereby extends across at least two, or at least three of the shielding walls 13. In an embodiment, the at least one longitudinal circumferential element 25 extends across four shielding walls 13 and thereby around the whole circumference of the shielding 1.

When the shielding 1 is arranged in a housing, a complementary retention element of the housing, such as a latching nose, can be inserted into the groove 27, thereby preventing the shielding 1 from moving out of the housing. Due to its longitudinal shape and at least partial arrangement along the circumference of the shielding 1, a device or retention element interacting with the element 25 can easily be shaped in the housing so that the shielding 1 may be used with different housings without the need for re-designing the shielding 1 itself.

In an embodiment, the groove 27 extends along the circumferential direction C of the shielding 1 and is thereby perpendicular to the longitudinal axis L and the insertion direction I. The groove 27 may extend along the whole circumference of the shielding 1, thereby extending through all four shielding walls 13.

The groove 27 is arranged behind the receptacle 17 with respect to the insertion direction I, as shown in FIG. 1. The groove 27 may define a rear end of the receptacle 17, the rear end being opposite the forward end 15 of the shielding 1. The groove 27 also extends in the region of a plurality of corners 31 of the rectangular cross section, the corners 31 being formed by bends 33 of the sheet material 11. At least two adjacent shielding walls 13 of the shielding walls 13 are planar and are connected with each other by the bend 33. A longitudinal direction of the bend 33 is parallel with the insertion direction I. The element 25 extends through the bend 33.

The cross-sectional shape of the groove 27 is, seen in a circumferential direction C (as seen best in FIG. 2), basically rectangular. The groove 27 is formed monolithically with the shielding walls 13. In an embodiment, the groove 27 is composed of a plurality of limiting walls 35 which are formed monolithically with the shielding walls 13. The limiting walls 35 have wall thicknesses 37 which are similar to wall thicknesses 39 of the shielding walls 13 adjacent to the groove 27, as shown in FIG. 2.

In the case of a rectangular cross section of the groove 27 in particular, the groove 27 is formed by three limiting walls 35: a front wall 41, a ground wall 43, and a rear wall 45, as shown in FIG. 2. The front wall 41 and the rear wall 45 extend perpendicular to the longitudinal axis L. The front wall 41 and the rear wall 45 are connected to each other by the ground wall 43 that extends perpendicular to the ground wall 43 and the wall 45. In other words, the groove 27 has an overall U-shape, wherein the ground of the U is formed by the ground wall 43 and is arranged deeper inside the shielding 1 then the adjacent shielding wall 13. In an alternative case where the longitudinal circumferential retention element 25 has the overall shape of a rib, the ground wall 43 may form the top of the rib that protrudes from the remaining shielding wall 13.

The cross section of the groove 27, in an embodiment, is uniform along the whole circumference of the shielding 1, except for the corners 31, as shown in FIG. 2. In other words, in each shielding wall 13, the groove 27 has a uniform depth 47 and a uniform width 49. In an embodiment, the uniform width 49 extends across the whole circumference. The depth 47 is measured along the radial direction R and the width 49 is measured along the longitudinal axis L parallel with the insertion direction I. In the case of a rib, the height is respectively measured as a radial height. The uniform width 49 may allow the usage of similar complementary retention devices in a housing for different sides of the element 25.

Figure 4:
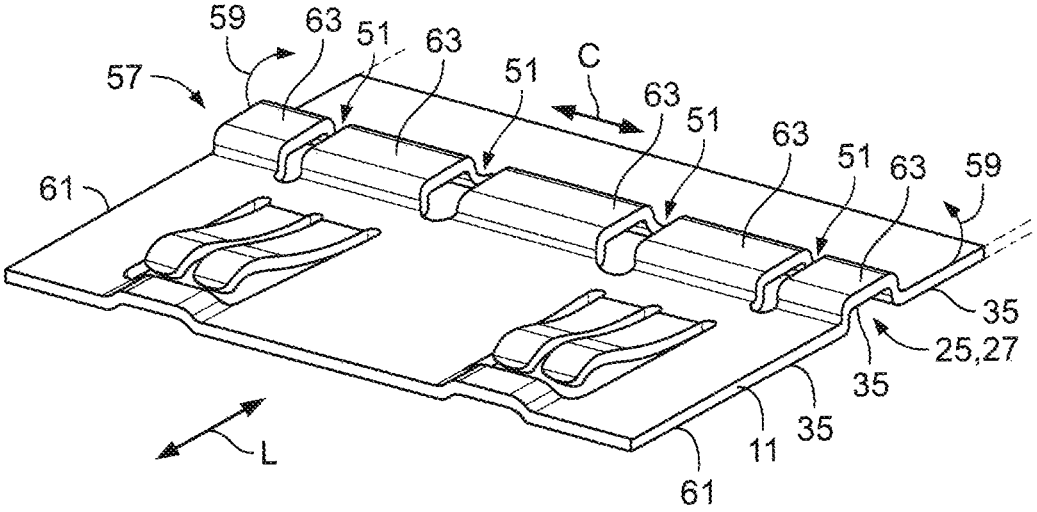
FIG. 4 is a perspective view of a sheet material prior to forming the shielding of FIG. 3.
Figure 5:
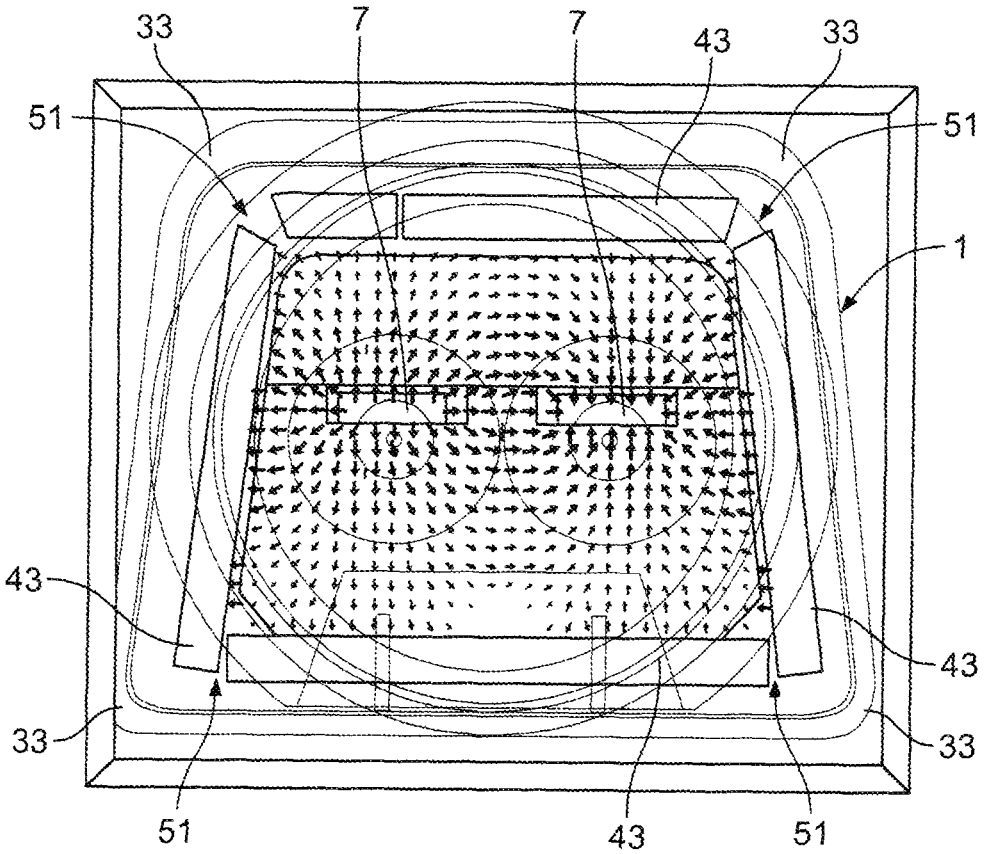
FIG. 5 is a schematic diagram of an electromagnetic field distribution in the shielding in a region of a groove.

In the intersections of the corners 31 or the bends 33 with the groove 27, cut-outs 51 extend through the material 11 of the shielding 1, as shown in FIGS. 4 and 5. The cut-outs 51 may be a through hole or a slit that extends parallel with the insertion direction I. In other words, the cut-outs 51 intersect with the groove 27. The cut-outs 51 are formed as through-holes extending along the radial direction R through the material 11. Each cut-out 51 has a basically longitudinal shape extending parallel with the longitudinal axis L. The cut-outs 51 extend at least over the width 49 of the groove 27. The cutouts 51 facilitate the formation of the shielding 1, in particular when the groove 27 is shaped into the material 11 prior to closing the sheet material 11 in order to form the receptacle 17, by allowing bending of the shielding 1 without interference of the element 25.

In order to prevent the shielding 1 from being inserted wrongly-oriented into a housing, the shielding 1 has at least one orientation feature 53. In the embodiment shown in FIGS. 1 and 2, the orientation feature 53 is formed as a protrusion 55 that extends from one of the shielding walls 13 along the radial direction R away from the remaining shielding wall 13. The protrusion 55 is arranged at the forward end 15 of the shielding 1. A housing that is provided with a receptacle for the shielding 1 may be provided with a slot for receiving the protrusion 55 in order to allow the insertion of the shielding 1 in only one orientation.

Figure 3:
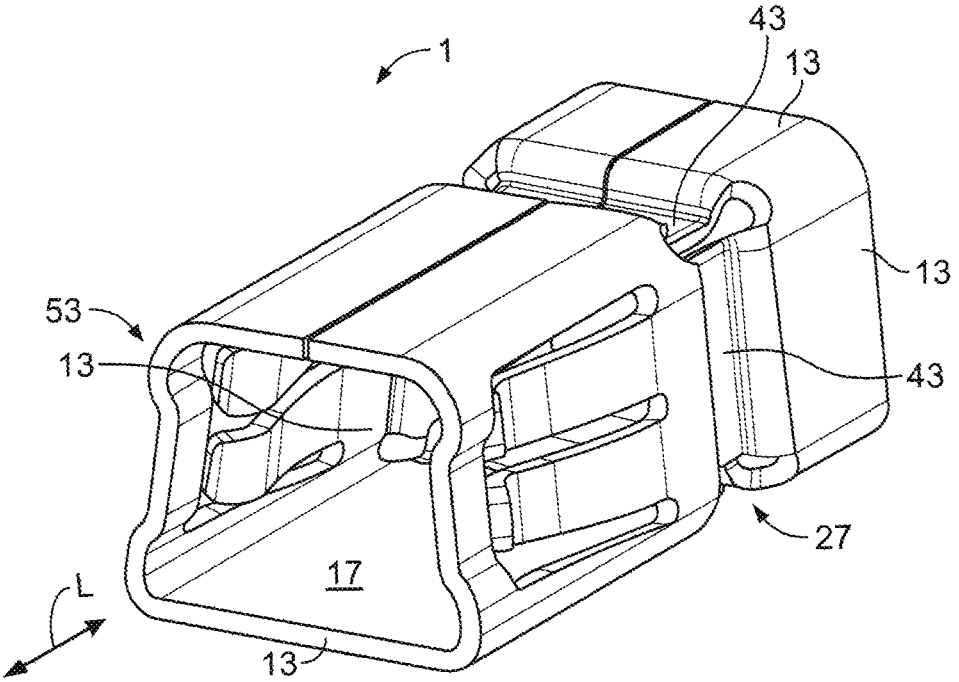
FIG. 3 is a perspective view of a part of a shielding according to another embodiment.

A shielding 1 according to another embodiment is shown in FIG. 3. For the sake of brevity, only the differences to the aforementioned embodiment described with respect to FIGS. 1 and 2 are mentioned. In FIG. 3, only the section comprising the receptacle 17 and the groove 27 is shown.

The shielding 1, as shown in FIG. 3, differs from the aforementioned embodiment in that the shielding 1 has an overall trapezoidal cross section perpendicular to the longitudinal axis L. Thereby, two shielding walls 13 are parallel with each other, whereas the two remaining shielding walls 13 are inclined towards each other, forming the trapezoidal cross section. This trapezoidal cross section allows omitting the protrusion 55 since the trapezoidal cross section itself forms an orientation feature 53 of the shielding 1. A corresponding housing should be provided with a receptacle for the shielding 1, said receptacle having a complementary trapezoidal cross-section.

The trapezoidal cross section, in an embodiment, extends through the majority of the shielding 1, including the groove 27. In other words, the four ground walls 43 of the groove 27 together form a trapezoid in a cross section perpendicular to the longitudinal axis L. Omitting the protrusion 55 allows for a dense packaging of signal connectors 3 in a given volume of a housing.

FIG. 4 shows sheet material 11 from which a shielding 1 as shown in FIG. 3 can be formed. The sheet material 11 is shown in a process step where the features for forming the groove 27 are already present. A longitudinal element 57 is formed in the sheet material 11 that has the overall shape of a rib extending perpendicular to a direction that will later become the longitudinal direction L. Said longitudinal element 57 comprises the limiting walls 35 that are, perpendicular to the longitudinal direction L, intersected by the cut-outs 51. The direction that is perpendicular to the longitudinal direction L will later become the circumferential direction C. The cut-outs 51 divide the longitudinal element 57 into sections 63.

The cut-outs 51 shown in FIG. 4 are formed in the regions in which the material 11 will be bent in order to form the shielding 1. Therefore, the material 11 will be bent in the directions indicated with the arrows 59 such that the lateral edges 61 abut each other and close the receptacle 17. The cut-outs 51 thereby allow the sections 63 that will later form the groove 27 to be moved towards each other without the sections 63 getting in contact with each other, thereby preventing the material 11 from being bent.

The longitudinal element 57 is formed in the flat sheet material 11 before the sheet material 11 is bent perpendicular to the longitudinal element 57, wherein the sheet material 11 is bent such that it forms shielding walls 13 for shielding at least one signal contact of the connector 3. The longitudinal element 57 forms the longitudinal circumferential retention element 25 in the shielding 1. The method for manufacturing the shielding 1 may further be improved by first forming the cut-outs in the sheet material 11 at cross sections of the longitudinal element 57 and the positions at which the sheet material 11 is bent to form the shielding 1 prior to forming the shielding 1.

Finally, FIG. 5 shows the electric field distribution in the shielding 1 in the region of the groove 27. Thereby, a cross-sectional view through the ground walls 43 of the groove 27 is shown. Between the ground walls 43, the cut-outs 51 extend, thereby forming openings in the shielding 1. As can be seen, the electric field, which is indicated by arrows, is large in the region of the signal contacts 7, but small in the regions of the bends 33. Due to this electric field distribution, the cut-outs 51 in the material 11 in the region of the groove 27 do not negatively influence the shielding properties of the shielding 1. In other words, sufficient electromagnetic shielding can be achieved even with the cut-outs 51 being in the shielding 1.

The shielding 1 as described above can be used with different kinds of housings without the need for re-designing the shielding and without negatively influencing the electromagnetic shielding properties.

What is claimed is:

1. A shielding for a signal connector, comprising:

a plurality of shielding walls arranged to electromagnetically shield a signal contact of the signal connector, at least two of the shielding walls are parallel with each other at least in sections in a cross-section perpendicular to an insertion direction;

a forward end open for receiving a mating connector along the insertion direction; and a longitudinal circumferential retention element extending along a circumferential direction of the shielding, the shielding is formed monolithically.

2. The shielding of claim 1, wherein the longitudinal circumferential retention element is a groove.

3. The shielding of claim 1, wherein the longitudinal circumferential retention element extends continuously along the circumferential direction of the shielding.

4. The shielding of claim 1, wherein the longitudinal circumferential retention element is formed by the shielding walls.

5. The shielding of claim 1, wherein the longitudinal circumferential retention element is limited by a limiting wall formed monolithically with at least one of the shielding walls.

6. The shielding of claim 1, wherein the longitudinal circumferential retention element has a uniform depth or height along the circumferential direction.

7. The shielding of claim 1, wherein the longitudinal circumferential retention element has a uniform width extending parallel with the insertion direction.

8. The shielding of claim 1, wherein the longitudinal circumferential retention element has an overall rectangular cross section extending perpendicular to the circumferential direction.

9. The shielding of claim 1, wherein at least a section of the shielding having the longitudinal circumferential retention element is a stamp-bent part.

10. The shielding of claim 1, wherein at least two adjacent shielding walls of the shielding walls are planar and are connected with each other by a bend, a longitudinal direction of the bend is parallel with the insertion direction.

11. The shielding of claim 10, wherein the longitudinal circumferential retention element extends through the bend.

12. The shielding of claim 11, wherein the longitudinal circumferential retention element has a cut-out in a region of the bend.

13. The shielding of claim 12, wherein the cut-out extends over a width of the longitudinal circumferential retention element.

14. The shielding of claim 1, wherein the shielding has an overall rectangular or trapezoidal cross sectional shape.

15. A method for manufacturing a shielding for a signal connector, comprising:

providing a flat sheet material;

shaping the flat sheet material by stamp-bending to form a longitudinal element in the flat sheet material; and bending the flat sheet material perpendicular to the longitudinal element after forming the longitudinal element, the sheet material is bent to form a plurality of shielding walls for shielding a signal contact of the signal connector, the longitudinal element forms a longitudinal circumferential retention element in the shielding.

16. The method of claim 15, wherein a plurality of cut-outs are formed in the sheet material at cross-sections of the longitudinal circumferential retention element and a plurality of bends prior to forming the shielding.

* * * * *